US005515343A

United States Patent [19]

Boucher et al.

[11] Patent Number: 5,515,343

[45] Date of Patent: May 7, 1996

[54] ELECTRO ACOUSTIC TRANSDUCERS COMPRISING A FLEXIBLE AND SEALED TRANSMITTING SHELL

[75] Inventors: Didier Boucher; Charles Pohlenz, both of Six-Four-les-Plages, France

[73] Assignee: ETAT FRANCAIS as represented by the Delegue General pour l'Armement, Paris, France

[21] Appl. No.: 360,945

[22] Filed: Apr. 28, 1989

[30] Foreign Application Priority Data

Apr. 28, 1988 [FR] France ..... 88 05661

[51] Int. Cl.[6] ..... H04R 17/00

[52] U.S. Cl. ..... 367/158; 367/163; 367/174; 310/337

[58] Field of Search ..... 367/141, 158, 367/159, 163, 174; 181/402; 310/337

[56] References Cited

U.S. PATENT DOCUMENTS 3,274,537 9/1966 Toulis .
3,974,474 8/1976 Izzo .
4,072,871 2/1978 Wilson .
4,845,688 7/1989 Butler ..... 367/174

*Primary Examiner*—J. Woodrow Eldred
*Attorney, Agent, or Firm*—Oliff & Berridge

[57] ABSTRACT

The invention relates to electro-acoustic transducers comprising a flexible and sealed transmitting shell referred to as flextensional transducers. A transducer according to the invention comprises one or more electro-acoustic drivers, e.g., a stack of piezoelectric plates 1*a*, 1*b* . . . 1*n*, located inside a flexible and sealed shell. Each piezo-electric driver comprises, at both its ends, a counter-mass coupled mechanically and acoustically with the stack and the ends of the shell by means of an axial threaded rod and two nuts screwed on the ends of the rod. The mass of the two counter-masses and the dimensions of the stack are determined so that the fundamental frequency of the axial oscillations of this mechanical assembly will be close to the natural frequency of the bending oscillations of the shell. An application of the invention is the construction of sonar transmitters.

5 Claims, 1 Drawing Sheet

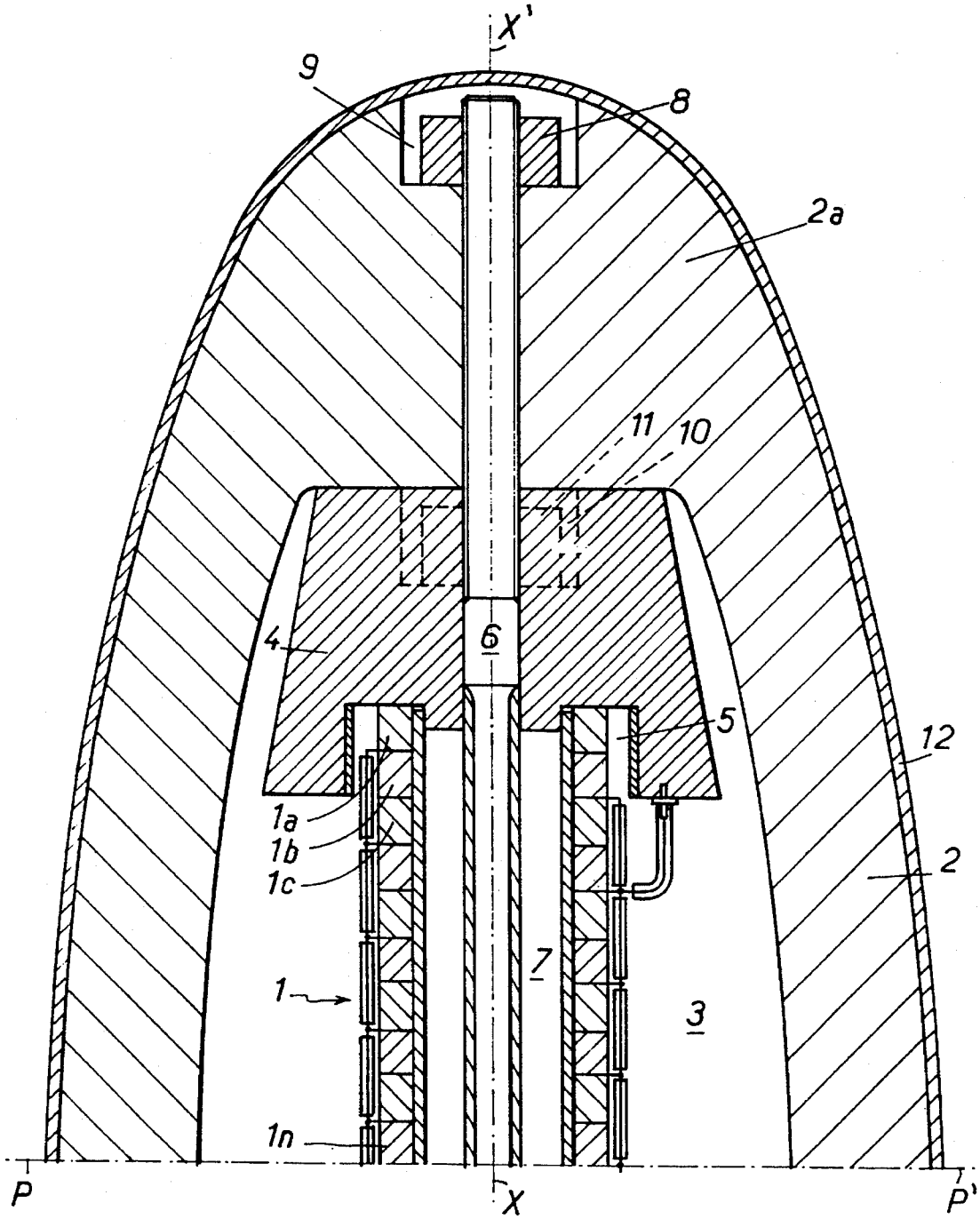
X'
9
8
2a
11
10
4
6
5
12
1a
1b
1c
2
7
1
3
1n
P
X
P'

ELECTRO ACOUSTIC TRANSDUCERS COMPRISING A FLEXIBLE AND SEALED TRANSMITTING SHELL

BACKGROUND OF THE INVENTION

This invention relates to new electro-acoustic transducers comprising a flexible and sealed transmitting shell.

The technical sector of the invention is that of submarine acoustics.

Known in the prior art are electro-acoustic transducers used for transmitting in the water low-frequency acoustic waves on the order of 1 KHz and comprising a driver usually made of a stack of piezo-electric ceramics which is located inside a sealed envelope or shell, constituting the transmitting surface in contact with the water.

These transducers are referred to as flextensional transducers. They fall into four classes depending on the general shape of the shell.

Class I corresponds to shells generated by revolution about an axis, of an ellipsoid shape and comprising a single driver made of a stack disposed along the major axis of the ellipsoid and coupled both mechanically and acoustically with the ends of the major axis of the shell. The tension and compression distortions along the major axis bring about bending distortions of the shell, with a maximum amplitude in the medial plane perpendicular to the major axis.

Class II corresponds to transducers with a shell in the form of a disk or torus generated by revolution about an axis perpendicular to the disk or torus plane. These transducers comprise piezo-electric drivers disposed radially about the axis and coupled at their ends with the shell which is then subjected to maximum bending distortions in the axis direction.

Class III corresponds to transducers with a shell showing two bulges at its both ends and in the general shape of a bone or a twinned-wheel.

Class IV corresponds to transducers with a shell in the form of a cylindrical chimney delimited by rectilinear generatrices resting on an elliptical cross-section or in the shape of a closed curve that can show a throat in its central portion. In that case, the transducer usually comprises a plurality of drivers parallel to one another, disposed in planes perpendicular to the shell generatrices and coupled with the shell at their both ends.

The present invention relates more particularly but not exclusively to Class IV flextensional transducers.

Flextensional transducers present well-known advantages.

They permit transmission of low-frequency acoustic waves because their transmitting frequency is the resonance frequency of the shell bending distortions and bending frequencies are low frequencies on the order of or smaller than 1 KHz.

These are compact and high-power transducers. They considerably amplify the amplitude of the piezo-electric stack oscillations because the expansion-compression motions about the stack centre-line are much greater than the motions at the ends of the shell which are coupled mechanically with the ends of the piezo-electric driver (s).

However, the flextensional transducers known to date have a relatively small coefficient of coupling between-the shell and the piezo-electric driver, on the order of 25% maximum and their pass-band is relatively narrow, with a medium frequency which is the natural frequency of the shell bending distortions generated by the drivers.

SUMMARY OF THE INVENTION

The aim of the present invention is to provide new flextensional transducers which have a much improved coefficient of coupling between the shell and the piezo-electric drivers and a wider pass-band.

The electro-acoustic transducers according to the invention are flextensional transducers,i.e. transducers-comprising one or more electro-acoustic drivers, and generally stacks of piezo-electric ceramics located inside a sealed and flexible shell and acoustically coupled at their both ends with the said shell, which is in contact with a liquid and acts as a transmitting surface.

The aim of the invention is met by means of a transducer wherein each electro-acoustic driver comprises, at its both ends, a counter-mass which is coupled mechanically with the said shell and with the said driver, and which is determined so that the fundamental frequency of the axial oscillations of the assembly consisting of the driver and the two counter-masses is close to the natural frequency of the shell bending oscillations.

According to a preferred mode of embodiment, the two counter-masses are determined so that the fundamental frequency of the axial oscillations of the assembly consisting of the driver and the two counter-masses will be slightly higher than the natural frequency of the shell bending oscill which results in the widening, due to the coupling of the two modes, of the transducer pass-band towards both low frequencies and high frequencies.

The invention provides for new electro-acoustic transducers of the flextensional type intended to transmit in the water low-frequency waves on the order of 1 KHz or below.

The transducers according to the invention present the advantages of the prior art flextensional transducers. Moreover, they obtain a wider pass band, particularly towards low frequencies, and they can thus transmit with a good efficiency, scanning a full range of low frequencies such as, for example, from 0, 5 KHz to 1 KHz.

The width of the pass-band of a transducer according to the invention equipped with counter-masses is about one and a half times as wide as that of the same transducer without counter-masses.

Moreover, the coefficient of electro-acoustic coupling of a transducer according to the invention is on the order of 40% whereas it is on the order of 25% for flextensional transducers without counter-masses.

As the acoustic power transmitted by a transducer is proportional to the square of the acoustic coupling coefficient, it is thus possible to obtain a large increase of the acoustic power which is multiplied by three or four for the same overall dimensions and for the same electric field of ceramic excitation.

BRIEF DESCRIPTION OF THE DRAWING

The following description refers to the single figure which shows an embodiment of a transducer according to the invention.

DESCRIPTION OF THE PREFERRED EMBODIMENT

The single figure is a half-cross-sectional view of a flextensional transducer. This half-cross-sectional view represents, for example, a half axial-cross-section of a Class I flextensional transducer which is generated by revolution about an xx' and spetrical as to a medial plane PP' perpendicular to the axis.

This half-cross-section can also be a transverse cross-section of a Class IV flextensional transducer which comprises a shell in the form of a cylindrical chimney the generatrices of which are perpendicular to the figure plane and which is symmetrical as to two perpendicular planes, the medial plane PP' and a longitudinal plane xx', both parallel to the generatrices of the shell, and which comprises a plurality of piezo-electric drivers parallel with one another and the axes of which are located in the symmetry plane xx'.

Transducers according to the invention are transducers known as flextensional transducers which comprise one or more electro-acoustic drivers 1, which are generally stacks of piezo-electric ceramics 1*a*, 1*b*, . . . 1*n*, but which cam be replaced by magnetostrictive drivers.

The driver(s) is/are housed in a sealed and flexible shell 2 which is in contact with sea water and delimits a cavity 3 filled with gas, accommodating the piezo-electric driver(s).

The shell 2 is ovoidal if it is generated by revolution, or has an oval cross-section if it is in the form of a cylindrical chimney, so that it comprises two ends 2*a* with a pronounced curvature, i.e. a very small radius of curvature, and it includes, in its medial section, i.e. in the medial plane PP', two areas with a slight curvature.

The two ends 2*a* are coupled mechanically with the ends of the piezo-electric driver(s).

When excited electrically, the ceramics 1*a*, 1*b*, . . . in are distorted axially, i.e. with expansion-compression oscillations parallel to the axis xx' and also radially. Axial motions are largely preponderate.

The axial distortions of the electro-acoustic motors are transmitted mechanically to the ends 2*a* of the shell and these motions result in bending distortions of the shell, and particularly in distortions parallel to the medial plane PP'. The amplitude of these distortions is maximum in plane PP' and much greater than the amplitude of the axial oscillations of the electro-acoustic drivers.

Flextensional transducers are well known and it is not necessary to describe them in detail. It should only be kept in mind that they convert the expansion-compression motions (extensional motions) of an electro-acoustic driver into a bending motion of a shell, hence their name "flextensional".

Flextensional transducers make it possible to transmit in the water low-frequency acoustic waves on the order of 1 KHz without using large and heavy transmitters, which is a great advantage.

The transmitting frequency of flextensional transducers is the natural frequency of the bending oscillations of the shell which acts as a transmitting surface, and this permits transmission of low frequency waves because the natural bending frequencies of a shell in the water are on the order of 0.5 to 2 KHz and thus much smaller than the fundamental frequency of the axial oscillations of a stack of piezo-electric ceramics which is on the order of 8 KHz.

However, the flextensional transducers known to date have a relatively narrow pass-band, which is centred on the natural frequency of the shell bending oscillations.

The piezo-electric drivers with which these transducers are equipped must be excited at a frequency which is several octaves smaller than their natural frequency, i.e. the natural frequency of their axial oscillations.

This,the conversion of electrical energy into acoustic energy performed by electro-acoustic drivers, is not optimal. Moreover, the electro-mechanical and thus electro-acoustic coupling between the ends of a ceramic stack and the ends of the shell are difficult to achieve and it is known from experience that the coefficient of electro-acoustic coupling of the flextensional transducers known to date is usually on the order of 25%, which considerably reduces the useful acoustic power of these transducers.

The aim of the invention is to build flextensional transducers with a widened pass-band, particularly towards low frequencies,and with a better coefficient of electro-acoustic coupling than the transducers of this type known to date.

This aim has been met by means of transducers comprising two flyweights or counter-masses 4 located at both ends of the driver and coupled both mechanically and acoustically with the latter and with the ends 2*a* of the shell 2.

The assembly comprising the piezo-electric driver and the two counter masses forms a mechanical spring and masses assembly with localized constants, and it is possible to calculate the values of these constants for this assembly to have a given fundamental frequency close to the natural frequency of the shell bending frequency, which makes it possible to obtain a wider pass-band including two close peaks.

From a technological viewpoint, it is easier to select the dimensions of the driver and of the two counter-masses so that the fundamental frequency of the axial oscillations of this mechanical assembly will be slightly higher than the natural frequency of the shell bending oscillations. This results in the widening due to the coupling of the two modes, of the pass-band towards both low frequencies and high frequencies. For example, let us consider a transducer having a shell with a bending frequency of 0,8 KHz and wherein the assembly formed by the driver and the two counter-masses has a fundamental frequency of 1 KHz. We thus obtain a transducer that has two close resonant frequencies and a widened pass-band ranging from 0,6 KHz to 1.2 KHz.

For the assembly comprising the stack of piezo-electric ceramics 1 and the two counter-masses 4 to be assimilable to a mechanical spring-mass assembly with localized constants, the mass of the stack must be smaller than that of the counter-masses and the elasticity of the stack along X X ' must be greater than that of the counter-masses.

If we reduce the diameter of the ceramics, we increase the risk of stack buckling, which is undesirable because it entails a useless power consumption and a mechanical fatigue of the ceramics. The problem can be solved by increasing the inner and outer diameters of the ceramic plates 1*a*, 1*b*, . . . 1*n*, thus making them less subject to bending while reducing the mass of the ceramics. For example, the stack 1 is 20 cm high and includes 20 ceramic plates 1*a*, 1*b*, . . . 1*n* in the from of rings with an outer diameter of 50 mm and the counter-masses are made of steel and weigh 3 kg. The shell 2 is made of aluminium alloy e.g., AU4G.

The single figure shows a mode of embodiment of the mechanical coupling between the stack 1, the counter-masses and the shell.

Each counter-mass 4 has a trapezoid section the large base of which is located on the stack 1 side and includes a hollow housing 5 which accommodates one end of the ceramic stack.

The two counter-masses include an axial hole accommodating a steel rod 6 which connects them through the space 7 located in the centre of the ceramics. The rod 6 is prolonged beyond the two counter-masses across tw axially in the ends 2*a* of the shell 2. The shell 2 may consist of two half-shells symmetrical as to the symmetry plane x x '.

Both ends of the rod 6 are threaded and two nuts are screwed on these threaded ends and rest on the bottom of a hollow housing 9 in the ends 2*a* of the shell.

Screwing the nuts tightens the rod 6 and applies strongly the shell ends against the counter-masses and the latter against the stack ends, hence providing a good mechanical and acoustic coupling between these elements.

According to a variant represented by dotted lines, the outer face of each counter-mass can include a hollow housing 10 which accomodates a second nut 11, which is screwed on the threaded rod 6.

In that case, the ceramic stack and the two counter-masses are assembled first by means of two nuts 11 secured to the rod 6, which provides for a mechanical coupling of the counter-masses and the ceramic stack, and then this prefabricated assembly is placed in the shell 2 and the two nuts 8 are screwed so as to obtain a mechanical coupling between the shell and the prefabricated assembly. The so-obtained coefficient of coupling is on the order of 40 to 45%.

Known in the prior art are electro-acoustic transducers of the tonpilz type which comprise a stack of ceramics-located between a flare and a counter-mass which acts as a fixed point.

In the present application, the counter-masses 4, interposed between the two ends of the stack and the two ends of the shell fulfill a function which is quite different from that of lowering the fundamental frequency of the driver so as to bring it to the vicinity of the natural frequency of the shell bending oscillations in order to widen the pass-band of a flextensional transducer.

The single figure shows a transducer comprising, additionally, in a known manner, a close skin 12 in which the transducer is fully wrapped and which is made of an elastomeric film.

The counter-masses 4 are made of a metal with a high coefficient of elasticity E such as steel, brass, tungsten, so as not to induce elastic distortions of the counter-masses and to have a good mechanical coupling.

We claim:

1. An electro-acoustic transducer comprising:

a sealed and flexible shell constituting a transmitting surface in contact with a liquid;

at least one electro-acoustic driver located inside said shell and coupled at both its ends with said shell; and a counter-mass at each end of each said electro-acoustic driver, said counter-masses being coupled mechanically with said shell and with said driver and being structured such that the fundamental frequency of the axial oscillations of the assembly comprising said driver and said counter-masses is close to the natural frequency of the bending oscillations of said shell.

2. An electro-acoustic transducer according to claims 1, wherein said counter-masses are structured such that the fundamental frequency of the assembly comprising said driver and its two counter-masses will be slightly higher than the natural frequency of the bending oscillations of said shell, so that the pass-band of said transducer is widened towards low and high frequencies.

3. An electro-acoustic transducer according to claim 1, wherein each counter-mass includes, on an inner face, a hollow housing which accommodates one end of the piezo-electric driver.

4. An electro-acoustic transducer according to claim 1, comprising a stack of piezo-electric ceramics in the form of rings surrounding a hollow central space; an axial metal rod, with threaded ends, passing through said central space, connecting together the two counter-masses, and passing through the two counter-masses and the two ends of the shell; and two nuts which are screwed on the threaded ends of said axial rod and which bear on the ends of the shell, thus tightening said rod so that its tension compresses the ceramic stack, the two counter-masses and the two ends of the shell and ensures a good mechanical and acoustic coupling.

5. An electro-acoustic transducer according to claim 4, wherein an outer face of each counter-mass comprises a hollow housing which accommodates a second nut, screwed on said axial rod and resting on said counter-mass so that it tightens said rod and couples mechanically and acoustically the two counter masses and said stack of piezo-electric ceramics.

* * * * *